US006607248B1

(12) United States Patent
Childress

(10) Patent No.: US 6,607,248 B1
(45) Date of Patent: Aug. 19, 2003

(54) LOW ELEVATION COAL PROCESSING PLANT

(76) Inventor: John J. Childress, 605 Club Cir., Daniels, WV (US) 25832

( * ) Notice: Subject to any disclaimer, the term of this patent is extended or adjusted under 35 U.S.C. 154(b) by 0 days.

(21) Appl. No.: 09/568,129

(22) Filed: May 10, 2000

Related U.S. Application Data

(60) Provisional application No. 60/140,447, filed on Jun. 23, 1999.

(51) Int. Cl.[7] ..... E21C 41/00

(52) U.S. Cl. ..... 299/10; 299/19; 209/9

(58) Field of Search ..... 299/7, 8, 10, 16, 299/18, 19; 209/9, 10; 52/169.5

(56) References Cited

U.S. PATENT DOCUMENTS

| | | | | |
|---|---|---|---|---|
| 1,520,230 A | | 12/1924 | Flath | |
| 1,720,704 A | | 7/1929 | Towne | |
| 2,413,243 A | | 12/1946 | Neff | |
| 3,431,736 A | | 3/1969 | Ueda | |
| 3,506,414 A | | 4/1970 | Skendrovic | |
| 3,870,373 A | * | 3/1975 | Doerr et al. | 302/14 |
| 4,060,281 A | * | 11/1977 | Doerr | 302/14 |
| 4,075,852 A | | 2/1978 | Tamaro | |
| 4,224,770 A | | 9/1980 | Petty | |
| 4,408,426 A | | 10/1983 | Ystebo | |
| 4,425,743 A | | 1/1984 | Bartur | |
| 4,466,759 A | * | 8/1984 | Sweeney et al. | 406/15 |
| 4,639,164 A | * | 1/1987 | Pugnale et al. | 405/54 |
| 4,706,423 A | | 11/1987 | Cariteau et al. | |
| 4,744,971 A | * | 5/1988 | Scherbel et al. | 423/323 |
| 5,507,628 A | * | 4/1996 | Masse et al. | 417/360 |
| 5,676,710 A | * | 10/1997 | Chedgy | 44/621 |

* cited by examiner

*Primary Examiner*—David Bagnell
*Assistant Examiner*—Daniel P Stephenson
(74) *Attorney, Agent, or Firm*—Merek, Blackmon & Voorhees, LLC

(57) ABSTRACT

The present invention is to an improved method of constructing a coal processing plant and an improved arrangement therefore. The overall cost of constructing a coal processing plant can be significantly reduced by the arrangement of the processing to terminate in an underground sump. By providing a subfloor to the plant with subterranean sumps, the overall height necessary to house a plant can be reduced significantly.

9 Claims, 1 Drawing Sheet

LOW ELEVATION COAL PROCESSING PLANT

This application claims the benefit of U.S. Provisional Application 60/140,447 filed Jun. 23, 1999, now abandoned.

BACKGROUND OF THE INVENTION

1. Field of the Invention

The present invention relates to an improved method of constructing a low elevation coal processing plant and an arrangement of a coal processing method therefor.

2. Description of the Prior Art

It has been the practice in the coal processing field to build a coal processing plant at the site of a coal reserve. A typical plant consists of a building structure measuring upwards of 50–85 feet in height housing or supporting the various levels of machinery necessary to process coal. The cost of the machinery and construction in a typical installation can reach the tens of millions. And due to the costs of transportation and labor, it is often more cost efficient to leave the majority of equipment and structures at the site after the reserve has been exploited than to move the plant to a new site.

The new approach taken by the present invention discloses a novel arrangement of equipment and structures which eliminates a great deal of the structure and presents a lower cost plant assembly which is easier to move and requires less labor and support housing.

SUMMARY OF THE INVENTION

Accordingly, it is a principal object of the invention to provide a new arrangement of machinery and equipment in a coal processing plant which simplifies the set up and construction of the plant.

It is another object of the invention to rearrange the equipment layout of a standard coal processing plant to reduce the required equipment and the attendant support structure required to support or house the equipment.

It is a further object of the invention to place the sumps of a coal processing plant beneath the ground ("floor") level of the plant to lower the height of equipment feeding into the sumps to reduce the overall housing structure height and costs associated therewith.

Still another object of the invention is to submerge within the sumps the pumps drawing materials out of the sumps to reduce the noise level ("sound pollution") associated with the pumps by taking advantage of the sound attenuation provided by the fluids within the sumps.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(s)

Figure 1:
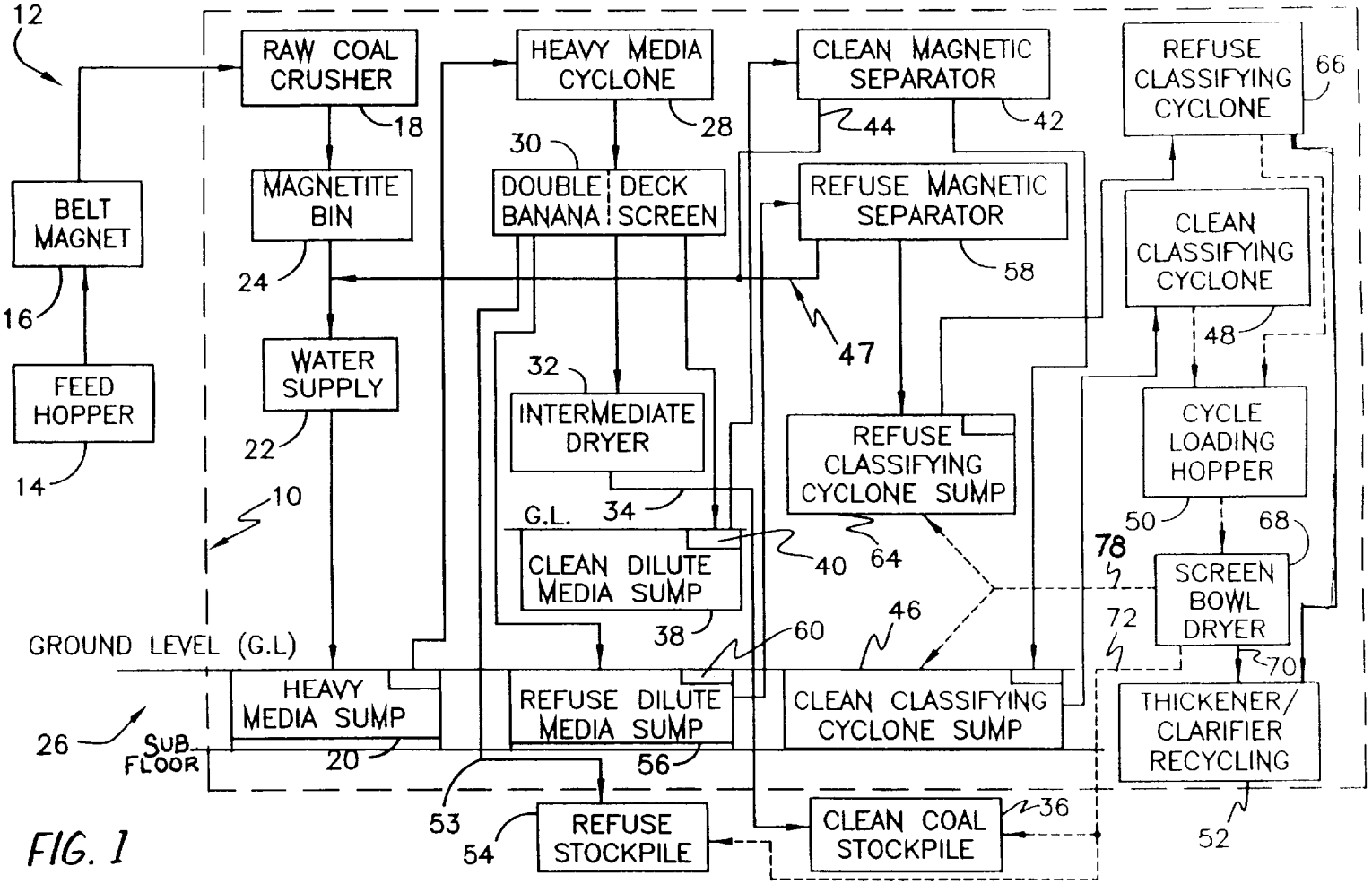
FIG. 1 is flow chart of a best mode coal processing circuit according to the present invention.

The present invention is to an improved method of constructing a coal processing plant and an improved arrangement therefor. While the exact layout of the coal processing flow sheet is not essential to take advantage of the current invention, a preferred arrangement will be described herein utilizing the current invention for demonstration purposes.

The central premise of the current invention is based on the fact that in addition to the main cost of the equipment used to process the coal, there is a secondary cost of providing housing structure supporting the equipment, and a cost to moving the equipment and support structure to the site. In addition, there will be a cost for set up and maintenance of the equipment and housing or support structure. If the amount of equipment can be reduced or simplified, then in addition to the equipment savings, there will be a savings in the structure supporting the equipment and a savings in transportation, set up and maintenance costs.

In order to advance this goal and take advantage of the savings implicit therein, a coal processing flow arrangement has been implemented which substantially improves the cost efficiency of constructing a coal processing plant by erecting all of the required equipment within a low elevation structure. The process performs the same task as previous methods, namely to process raw coal and separately output the clean coal at some defined purity ands output the refuse separated from the coal. The output capacity and processing efficiency are substantially the same whether using the new process or a prior art process, and the improvement of the capacity and processing efficiency are not the primary goals of the current invention. Instead, by reducing the cost of setting up, transporting and housing the equipment, a coal processing plant according to the present invention can be used to economically mine smaller reserves, or the savings can be used to provide a coal processing plant of higher capacity (additional equipment) at a lower overall cost.

A coal processing plant according to the current invention substantially lowers the cost of the housing and support structure around the equipment by using the latest Programmable Logic Computer (PLC) and other high efficiency equipment currently available in the market in combination with an improved arrangement of the equipment without suffering any performance losses. Because much of the equipment gravity feeds from one machine to the next, it is the current practice to provide a support structure ("housing") of typically 50 to 85 feet with coal processing taking place sequentially from the top floor to the ground floor with steel chutes or other means transferring the raw materials from one floor to another. Raw coal enters the top of the structure by conveyor belt and is processed by initial screens or other machinery and works its way through the process equipment on lower floors sequentially until the final refuse and clean coal exit through the ground floor by another conveyor belt where they can be transported away.

The current invention discloses a method whereby the coal is processed in a number of sub-circuits, each intermediate sub-circuit ending in a collection sump located below the ground level, and then pumped by a submerged sump pump to the top of the next sub-circuit. This positioning, together with an optimized processing circuit, reduces the required housing height from 75 or 85 feet down to 15–20 feet. The saving inherent in the housing structure alone with the requisite engineering, platework, concrete, foundation, piping, labor and maintenance expenses is enormous. The reduction in housing height also results in a reduction in the number of total length of steel chutes in the building, lowering a substantial source of noise pollution within the plant as material slides down the chutes from one piece of machinery to another. In addition by submerging within the sumps the pumps which carry materials away from the sump instead of using external, horizontal centrifugal pumps, a substantial noise pollution reduction can be had.

Referring now to the drawings, a preferred method of processing coal 12 according to the invention is described. Raw coal (not shown) mined from a reserve is dumped into a feed hopper 14. From the feed hopper the coal travels along a conveyor belt past a belt magnet 16 enters the coal processing plant housing 10 and into a rotary coal crusher 18 or similar device. The crusher breaks the raw coal into particles of less than a defined size, and may incorporate a screen to further define the size of coal exiting the crusher. From the crusher the crushed coal is deposited into a first sump ("heavy media sump") 20 and mixed with water from a water supply 22, which is added automatically by appropriate control systems to maintain the water level in the sump. Also in the sump, magnetite powder from a magnetite bin 24 is added to the water/coal slurry to produce a slurry having a specific gravity approximately equal to that clean coal in preparation of processing the slurry.

Importantly, the sump is located below the ground surface (G.L.) 26 and may consist of a stand alone sump 20 or a particular section of a larger sump. A sump pump 20 and its associated motor are situated in the sump to transfer the mix to a heavy-media cyclone 28.

The heavy-media cyclone processes the slurry mix to separate the lighter particles (clean coal) and the heavier particles (waste). The separated products then enter a double deck banana screen 30 or similar device to separate and filter out fine particulates. Clean coal entering a first chute of the double deck banana screen filters coal to a first level which is then filtered again to a second level. Coal which passes over the first screen and coal which passes over the second screen are accepted as clean coal and pass through a dryer 32 before being carried out by a conveyor 34 to a clean coal stockpile 36. Coal which is of a size to filter through the first and second screens is deposited into a second, sub-ground level sump ("clean dilute media sump") 38 before being sent to a classifying circuit cyclone for further classifying.

Coal from the clean dilute media sump 38 is pumped by a submerged sump pump 40 to a magnetic separator 42 to separate magnetic particles and magnetite out of the media and back to the inlet supply line intermediate the raw coal crusher and heavy media sump for re-use line 44). Once the de-magnetized media has exited the magnetic separator 42 the media enters a clean coal classifying sump 46 below the ground level where it is pumped to a fine coal classifying cyclone 48 ("clean classifying cyclone").

The fine coal classifying cyclone 48 receives media from the clean media sump 46 and separates by centrifugal force the smaller and larger particles, compared to the heavy-media cyclone 28 which separates by weight of the particles. The larger particles exiting the bottom end of the cyclone 48 are deposited into the first compartment of a two compartment hopper 50. The smaller particles are transferred to a chemical thickener/clarifying circuit and belt press 52 to recover the particles and clarify the water for re-use.

The second flow from the heavy media cyclone 28 which was separated as refuse enters a similar banana double deck screen chute 30. Large particles which pass over the first or second deck filter are conveyed 53 out of the plant to a refuse stockpile 54. Particles which are small enough to pass through the double screens are deposited into a third, below ground sump ("refuse media sump") 56 before being sent to a second cyclone 66 for classifying.

The fine refuse classifying cyclone 66 receives slurry media from the refuse media sump 56 and separates the slurry (after removal of the magnetite) in a manner analogous to the clean media line. Media from the refuse media sump 56 is pumped by a submerged sump pump 60 to a refuse magnetic separator 58 to separate magnetic particles and magnetite out of the media and back to the inlet supply line intermediate the raw coal crusher and heavy media sump for re-use (line 46). Once the de-magnetized media has exited the refuse magnetic separator 58 the media enters a refuse classifying sump 64 below the ground level where it is pumped to a refuse classifying cyclone 66. The larger particles from the cyclone 66 are deposited into the second compartment of the two-compartment hopper 50, while the smaller particles are sent to the thickener 52 to recycle the water and remove the fine coal or rejected particles.

The two-compartment hopper in conjunction with a timing circuit and appropriate valves alternately send material to a screen bowl dryer 68 which operates on a duty cycle to alternately screen and dry the fine clean coal and the refuse. A drain 70 at the bottom of the first part of the screen sends a large portion of the removed water to the thickener for further processing. A second drain 74 sends coal or refuse rich water slurry back to the coal media sump or refuse media sump as appropriate to the cycle for further processing. Solid particles surviving the screen bowl dryer 68 are sent (line 72) to the clean coal conveyor or the refuse conveyor (line 78) for deposit in the appropriate stockpile 36,54.

As can be seen from the process described, a large amount of equipment is required for the basic coal processing circuit. Routing the coal, slurry, water, magnetite, etc. through the circuit has been traditionally accomplished by stacking the equipment in floor above floor in buildings 50 to 75 feet higher so that the media can gravity feed from one processing machine to the next. However, when the total cost of buying, transporting, and installing the machinery is factored in with the support housing and maintenance and labor, it is now possible by using the latest equipment and the subterranean installation of the sumps, to produce a plant of equivalent processing capability and production rates with only a fraction of the housing and support costs.

The enclosed circuit performs all of the tasks of earlier circuits and can produce the same production rates as earlier plants costing tens of millions of dollars. In fact, considering the decreased set up time, it is possible to increase production by moving up the start date using the simplified plant construction techniques described herein. By digging a hole or holes of appropriate size to hold the sump(s) described herein, the number of floors and levels can be reduced, and utilizing the efficient cycle described herein with the latest equipment, even more floors are eliminated. The total height of a coal plant according to this invention has been reduced to 15 to 20 feet from 75 feet. As discussed above, a commensurate reduction in the number of metal chutes from one component to the one below it, and by installing the sump pumps and their motors submerged within the sump, the overall sound pollution, a recognized problem within the industry, is drastically reduced.

The sump pumps allow each sub-circuit within the coal processing circuit to be performed efficiently in a few steps starting only a level or two above the ground and proceeding sequentially through the sub-circuit processes and ending in a below ground sump, and then use the sump pumps to transfer the slurry to the top of the next sub-circuit for further processing. By reducing the overall height of the building, savings occur in concrete required for the foundation, plate work, piping, labor, maintenance, transportation, and engineering design. Additionally, transportation and re-construction costs are lowered to the point where it is economically feasible to relocate the plant after the coal reserve is depleted to a new site. A further advantage is that it is possible with the reduced construction cost to tap smaller reserves which were previously not economically feasible to tap, often requiring that the coal be transported tens of miles or further to a processing plant, rather than more efficiently moving the plant to the site.

In constructing the site, a number of holes are dug into the ground and cemented or otherwise stabilized to receive the sump(s). The foundation is also simultaneously set for the building structure. The housing or support structure is then constructed with appropriate piping and supports to receive the equipment for the coal processing circuit. The equipment and sumps are installed throughout the housing in proper relation to each other and to the sumps of the particular circuit or sub-circuit. Chutes or other transfer devices for routing the coal, refuse, and slurry through the circuit are positioned to connect the equipment in proper order. The raw coal is then mined and sent through the circuit as described above and clean coal and refuse are outputted to stockpiles outside the building for transportation to the next user or disposal as required.

It is to be understood that the present invention is not limited to the sole embodiment described above, but encompasses any and all embodiments within the scope of the following claims.

I claim:

1. A coal processing plant comprising:

a ground floor constructed at a ground level of a preselected coal processing site;

a housing structure provided above said ground floor, said housing having an average height of less than 25 feet above said ground floor;

at least a plurality of coal processing subcircuits within said housing structure for processing coal;

each of said plurality of coal processing subcircuits including at least one coal processing machine and producing at least an amount of coal slurry media;

at least one sump receiving means defined below said ground floor for receiving a plurality of coal processing sumps; and said plurality of coal processing sumps each receiving an amount of the coal slurry media from one of said plurality of coal processing subcircuits and transporting an amount of the coal slurry media to another of said plurality of coal processing subcircuits for further processing.

2. A coal processing plant according to claim 1 further wherein said at least one sump receiving means is a sub-floor.

3. A coal processing plant according to claim 1 further wherein said sub-floor supports each and every sump in said coal processing plant.

4. A coal processing plant according to claim 1, wherein said coal processing plant includes five sub-circuits, wherein at least three of said sub-circuit terminate in one of said plurality of coal processing sumps.

5. A coal processing plant according to claim 1, wherein each coal processing sump is placed below ground level.

6. A coal processing plant according to claim 1 further wherein said sump receiving means includes a plurality of means defining holes in said ground floor for housing at least one of said sumps therein.

7. A method of constructing a coal processing plant comprising the steps of:

(a) selecting a site for constructing a coal processing plant having a ground level for constructing a coal processing plant foundation thereon;

(b) digging at least one hole below said ground level to form walls defining said hole and a subterranean floor in said hole for receiving a plurality of sumps therein, wherein at least a portion of each of said sumps is below said coal processing plant foundation ground level;

(c) constructing a coal processing housing on said foundation having an average height of less than 25 feet above said coal processing plant foundation, (d) providing in said coal processing housing a plurality of coal processing sub-circuits, each of said plurality of coal processing subcircuits including at least one coal processing machine and producing at least an amount of coal slurry media;

(e) arranging said coal processing sub-circuits such that an amount of the coal slurry media produced by one of said plurality of coal processing sub-circuits is transferred into one of said sumps and subsequently transported to another of said plurality of coal processing subcircuits for further processing.

8. A method of constructing a coal processing plant according to claim 7 further including the steps of:

(f) positioning at least one of said sumps entirely below said ground level.

9. A method of constructing a coal processing plant according to claim 7 further including the steps of:

(g) stabilizing the said subterranean floor by constructing a permanent floor thereon; and (h) stabilizing said ground level by constructing a permanent foundation thereon.

* * * * *